United States Patent [19]

Crossman

[11] Patent Number: 4,901,838

[45] Date of Patent: Feb. 20, 1990

[54] COIN HANDLING SYSTEM FOR TELEPHONE PAY SYSTEM EMPLOYING LEVERS TO REGULATE COIN MOVEMENT

[75] Inventor: Thomas Crossman, Liverpool, Great Britain

[73] Assignee: GEC Plessey Telecommunications, Ltd., Coventry, England

[21] Appl. No.: 108,853

[22] Filed: Oct. 14, 1987

[30] Foreign Application Priority Data

Oct. 30, 1986 [GB] United Kingdom ..... 8626013

[51] Int. Cl.[4] ..... G07F 1/04

[52] U.S. Cl. ..... 194/346; 194/317

[58] Field of Search ..... 194/229, 231, 232, 237, 194/317, 318, 319, 325, 334, 335, 338, 344, 346

[56] References Cited

U.S. PATENT DOCUMENTS

| | | | |
|---|---|---|---|
| 1,452,980 | 4/1923 | Mills | 194/344 |
| 4,106,610 | 8/1978 | Heiman | 194/317 |
| 4,399,902 | 8/1983 | Holland et al. | 194/346 |

FOREIGN PATENT DOCUMENTS

| | | | |
|---|---|---|---|
| 0669343 | 12/1938 | Fed. Rep. of Germany | 194/346 |
| 0957108 | 2/1950 | France | 194/346 |
| 2382061 | 9/1978 | France | 194/334 |
| 0024932 | 9/1931 | Netherlands | 194/346 |
| 0009714 | of 1906 | United Kingdom | 194/346 |
| 0423483 | 2/1935 | United Kingdom | 194/346 |

*Primary Examiner*—Joseph J. Rolla
*Assistant Examiner*—Edward S. Ammeen
*Attorney, Agent, or Firm*—Michael F. Oglo; Julian C. Renfro

[57] ABSTRACT

The coin handling system prevents coin to coin contact taking place in coin operated equipment. This is achieved by an arrangement whereby the presence of a coin activates a first lever which moves a second lever in the coin path behind the coin so that a subsequent coin abuts the second lever. A series of such levers are employed in the coin store of coin operated equipment, the actual number depending upon the number of coins to be stored. When the first coin is cleared from the store by a suitable gate arrangement, all coins move along the store by one position, the separation being maintained by the interaction of the levers and coins. The advantages of the system are that a wider range of coins from one coin set can be accommodated in a single store than is presently possible. The coin insertion sequence is maintained for the purposes of microprocessor control since a single store is used. Since coins cannot overtake each other the risk of coins jams is lessened.

12 Claims, 1 Drawing Sheet

Figure 1:
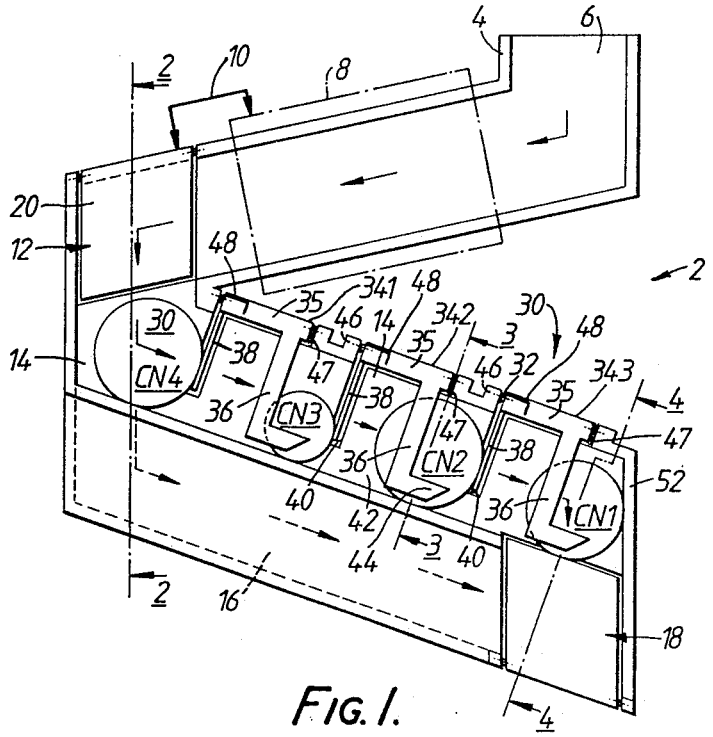

COIN HANDLING SYSTEM FOR TELEPHONE PAY SYSTEM EMPLOYING LEVERS TO REGULATE COIN MOVEMENT

The present invention relates to a coin handling system, and finds particular application in telephone pay systems.

In many coin operated machines, coins are inserted into a store where they are held in readiness and used for the purchase of goods or services. Unused coins are returned to the customer at the end of the transaction.

In configurations which allow the coins to roll as part of their passage through the coin handling system one major problem arises in the coin storage area.

The problem is that if a variety of coin denominations are to be accepted and stored in known sequence, then if a single coin store is used, the width of the store has to be such that the thickest coin in the coin set will pass freely along it. Unfortunately this requirement often means that the thinnest coins in the coin set now have sufficient space to overtake one another thereby upsetting the sequence of the coins and causing coin jams.

Previous coin handling systems used in pay telephones attempt to overcome the problem of thick and thin coin storage by using separate stores either in a co-planar of 'X' cross-section configuration such that coins cannot overtake each other.

The disadvantages of these systems are the increased size because of extra stores area, the extra mechanisms necessary to direct coins to the appropriate store, the risk of coins entering the wrong store, more complicated operation, increased cost and the need for fine adjustments to be made to ensure satisfactory performance.

The invention overcomes the above mentioned disadvantages by storing thick and thin coins in the same store in the sequence of insertion, preventing overtaking by placing stops between adjacent coins.

According to one aspect, the invention provides a coin handling system including a coin store having a plurality of pivoted levers placed in a coin path of the coin store, the levers being pivotally mounted along a common axis and arranged to be moved from a blocking position by contact with a coin rolling through the coin store, and returned to a non-blocking position after the coin is no longer in contact with each lever, except for the final lever in the coin store which is held in the blocking position by the coin coming to rest against the stop at an end of the coin store and remaining in contact with the lever, wherein a subsequent coin entering the coin store travels down the store until it comes to rest against the lever blocking its path and operates an adjacent lever by contact therewith to block the path behind the subsequent coin.

According to another of aspect the present invention, there is provided a coin handling system including a coin store having a plurality of interconnected pivoted levers placed in a coin path of the coin store, the levers being pivotally mounted about an axis or axes extending along the coin path to be moved selectively in or out of the coin path by contact with the side of a coin rolling through the coin store, a stop in the coin store for holding a coin at the end of the coin path whereat a lever is caused by contact with the side of the coin to move an interconnected lever into a coin path blocking position behind the coin whereby a subsequent coin entering the coin store travels down the store until it comes to rest against the second mentioned lever blocking its path and thereupon moves a third adjacent lever by contact therewith to cause a fourth interconnected lever to block the path behind the subsequent coin.

Figure 2:
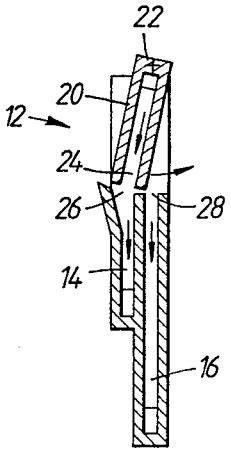
Figure 3:
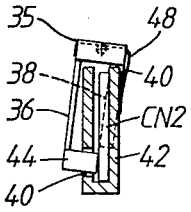
Figure 4:
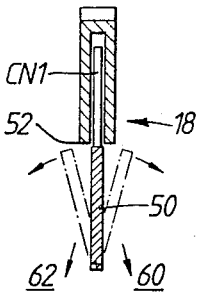

An embodiment of the present invention will now be described with reference to the accompanying drawings wherein:

FIG. 1 shows a side view of a body part of a coin handling system,

FIG. 2 is a cross-sectional view of an accept/reject gate along the line 2—2 of FIG. 1, FIG. 3 is a cross-sectional view along the line 3—3 of FIG. 1 of a lever activated by the presence of coin, and, FIG. 4 is a cross-sectional view along the line 4—4 of FIG. 1 showing a cash refund gate.

Referring to the drawings, the coin handling system comprises a body part 2 having a downwardly-inclined channel 4 down which coins are allowed to roll at a certain angle from a point of entry 6. A coin validator 8 of known construction shown schematically in dotted lines provides a means of electronically checking the authenticity and value of the coin as it rolls along the channel 4. By this means a signal will be sent by means indicated schematically as at 10 to an electrically operated gate 12 which directs the coin into a coin store 14 if it has been found to be valid or directs it to a reject chute 16 and hence back to the user via cash/refund gate 18 if found invalid.

Coin store 14 is formed as a downwardly inclined chute leading to cash/refund gate 18. Reject chute 16 is formed as a downwardly inclined chute positioned directly beneath chute 14 and also leads to cash/refund gate 18 positioned at the end of the chute.

The coin channel system consists of three plastics injection moulded items; the body moulding 2 as shown being the prime part which determines the maximum diameter and thickness of coins which may be accepted, a cover (not shown) which forms a side closure to the coin store and the main part of the reject chute and lastly a side cover (not shown) to the channel 4. An injection moulded part is provided (not shown) which allows for the mounting of electrical devices for the operation of the system.

Accept/reject gate 12 is shown in greater detail in FIG. 2.

Gate 12 comprises an inverted U-shape member 20 pivotable about an axis 22 extending through its base in an anti-clockwise direction from a position as shown in which the open end 24 of the member 20 is disposed directly above the open end 26 of coin store 14, to a position in which open end 24 is disposed directly above open end 28 of reject chute 16.

Positioned along the top of coin store 14 is a series of levers 30 pivotally mounted on a common longitudinal pivot member 32. Three sets of levers 341, 342, 343 are provided, each lever set comprising a tubular bearing member 35 mounted on pivot member 32 and a first L-shaped lever portion 36 downwardly extending from bearing member 35 at the lower end of member 32 and a second lever portion 38 downwardly extending from bearing member 35 at the upper end of member 32. The levers extends through slots 40 in the sides 42 of the store 14, as is shown in FIG. 3. It can be seen lever 36 has an inwardly extending portion 44 at its lower end. Stationary portions 46 are provided between lever sets 341,342 and 343, and a damping medium 47 is provided between the front bearing surfaces of members 35 and the adjacent surfaces of portion 46. The levers may be biased to central positions by integral weights, leaf or, as shown, torsion spring 48.

Accept/reject gate 18, shown in detail in FIG. 4 comprises a member 50 disposed beneath an open end 52 of coin store 14 and being pivotable to left or tight to a cash box 60 or a cash refund cup 62.

The gates 12, 18 may be returned by leaf, torsion or extension springs (not shown). Solenoids or other electrical devices may be employed to operate the gates 12, 18. Photo-electric sensors may be provided to monitor coin positions and pass information to a central processor which will control the functions of the coin handling system. Gates 12, 18 and levers 30 are manufactured by an injection moulding process from a material having low friction characteristics.

Thus in operation, a coin CN1 is inserted into chute 4, rolls down the chute and is validated by validator 8. If the coin is valid, the coin is passed through accept-/reject gate 12 into coin store 14. The coin engages a first lever set 341, causing it to move aside in an anti-clockwise direction. There being at this stage no stop in the path of the coin, it will continue to roll down the coin store and the lever 341, will return to its rest position. Second lever set 342 will similarly be moved aside and return to rest by the passage of the con. Third lever set 343 will also be moved aside by this time the coin will be stopped by the end wall 52 of the coin channel. This end wall is positioned relative to the lever so that when the coin has come to a stop, lever set 343 is prevented from returning to its rest position.

When the coin is against the end wall it is supported by the top surface of member 50 of gate 18.

With the lever 36 of lever set 343 (FIG. 3) now in a raised condition due to the presence of the first coin CN1, lever 38 is brought into the coin path behind coin CN1 and prevents contact between any subsequent coin and the first coin.

A second coin CN2 entering the coin store will activate lever sets 341, and 342 in a similar manner to the first coin but because of the position of lever set 343 in the coin path, this second coin CN2 is stopped by lever set 343, and lever set 342 is left in the raised position by the presence of the coin. As before the lever 38 of lever set 342 will block the path of subsequent coins.

A third coin CN3 entering the store will activate lever set 341 come to a stop against lever set 342 and as previously the coin will prevent the return of lever set 341 causing it to block the path of subsequent coins.

In this example the coin store is required to store four coins so the fourth and last coin CN4 will come to rest against lever 38 of lever set 341. It will not activate any lever whilst in this position.

At this stage all coins are static and cannot touch each other. The system now awaits a command either to direct coins to a cash container in payment for goods or services, or to a refund cup for return to the customer.

If a coin is to be directed to a cash container, gate 18 which is situated directly below the first coin CN1 is electrically operated causing this coin to drop vertically. Once the coin has cleared the gate, the gate will close. FIG. 4 shows movable gate 18 which is pivoted to allow the coin CN1 to pass to a cash box 60 or to a refund cup 62. This coin having been removed from the coin store, ceases to hold lever set 343 in the raised position and so lever set 343 returns to the rest position. This action thus releases the coin held by the lever 38 of lever set 343 and consequently this coin is free to roll down the coin store. It lifts the lever 36 of 343 and maintains the lever in the raised position as the coin is stopped at the end wall. Lever sets 342 and 341 react in a similar manner and all coins move down the runway in turn to occupy the next lower position. This then leaves space available at the top end of the coin store for the insertion of a further coin if necessary.

Should it be necessary to refund money to the customer, the movable gate 18 is operated for a set period in the opposite direction to that previous and coins leave the coin store and are directed to a refund cup 62.

I claim:

1. A coin handling system, comprising:

a coin entry means, electronic control means including a coin validator means for checking the validity of a coin entered into the coin entry means, accept-/reject gate means having first and second exists and controlled by the coin validator means for passing accepted coins to said first exit and rejected coins to said second exit;

a coin store coupled to said first exit of said coin entry means to receive accepted coins from said first exit, the coin store including a coin path along which coins move;

a plurality of lever means positioned along the coin path for defining coin positions along the coin path, and axis means extending in the direction of the coin path about which the lever means are pivoted;

each said lever means comprising first and second interconnected levers, the first lever being positioned forward of the second lever in the direction of the coin path and the levers being arranged such that as the first lever moves out of the coin path, the second lever moves into the coin path;

the coin store including a stop means at the end of the coin path for a first coin position;

whereby in operation a first coin entering the coin store moves along the coin store into abutment with said stop means in which position the first lever of a first lever means is moved out of the coin path by said first coin while the second lever moves into the coin path behind the first coin to define a second coin position, so that a second coin entering the coin store moves to the second coin position at which position the first lever of said second lever means is moved out of the coin path by said second coin while the second lever is moved into the coin path behind the second coin to define a third coin position.

2. A system according to claim 1 including a main body determining the size of the coin store and coin path, the coin path being elongate and narrow in a width dimension, and the first lever of each lever means extending in an inoperative position on one side of the width dimension of the coin path, and the second lever of each lever means extending in an inoperative position on the other side of the width dimension of the coin path.

3. A system as claimed in claim 2, wherein the main body has panels constituting the sides of the coin path, the panels having slots therein to receive each of said first and second levers which are generally co-planar with the side panels in the inoperative position.

4. A system as claimed in claim 2 wherein each said first lever has a portion at its free end extending into the coin path in an inoperative position so that a coin moving along the coin path strikes said portion to cause movement thereof with consequential movement of the second lever in to the coin path.

5. A system as claimed in claim 1 wherein the axis means comprises a longitudinal pivot member extending parallel to the coin path, and each lever means has a tubular bearing member mounted on said pivot member.

6. A system as claimed in claim 5 wherein spacing members are provided between adjacent tubular bearing members, and damping means is provided between a spacing member and an adjacent tubular bearing member to dampen movement of the respective lever means.

7. A coin handling system as claimed in claim 1, wherein a cash/refund gate is positioed at the end of the coin store adjacent said stop means and arranged to be operated to allow a coin adjacent to the stop means to pass to a cash box or to a refund cup.

8. A coin handling system as claimed in claim 1 wherein said coin store comprises a main body. the main body having panels which define an entry region and said coin store, the panels determining the maximum diameter and thickness of coins which may be accepted by the system.

9. A coin handling system as claimed in claim 8 wherein the main body is manufactured by a plastics injection moulding process.

10. A coin handling system as claimed in claim 1 wherein said lever means are manufactured by an injection moulding process from a plastics material having low friction characteristics.

11. A coin handling system as claimed in claim 1 including spring means for biasing the lever means to an inoperative position.

12. A coin handling system. comprising:

a coin entry means, electronic control means including a coin validator means for checking the validity of a coin entered into the coin entry means, accept-/reject gate means having first and second exits and controlled by the coin validator means for passing accept coins to said first exit and rejected coins to said second exit;

a coin store coupled to said first exit of said coin entry means to receive accepted coins from said first exit, the coin store including a coin path along which coins move;

a main body determining the size of the coin store and coin path, the coin path being elongate and narrow in a width dimension, and the main body including panels constituting the sides of the coin path, the panels having slots therein;

a plurality of pivoted lever means positioned along the coin path for defining coin positions along the coin path, each said lever means comprising first and second interconnected levers, the first lever being positioned forward of the second lever in the direction of the coin path, the first lever being disposed in an inoperative position on one side of the coin path, and the second lever being disposed in an inoperative position on the other side of the coin path, the levers being received in said slots so as to be generally co-planar with said panels in an inoperative position, and the levers being arranged such that as the first lever moves out of the coin path, the second lever moves into the coin path;

the coin store including a stop means at the end of the coin path for a first coin position;

whereby in operation a first coin entering the coin store moves along the coin store into abutment with said stop means in which position the first lever of a first lever means is moved out of the coin path behind the first coin to define a second coin position, so that a second coin entering the coin store moves to the second coin position at which position the first lever of a second lever means is moved out of the coin path by said second coin while the second lever is moved into the coin path behind second coin to define a third coin position.

* * * * *